US008132326B2

(12) United States Patent
Castrén

(10) Patent No.: US 8,132,326 B2
(45) Date of Patent: Mar. 13, 2012

(54) METHOD AND APPARATUS FOR FORMING A FINNED HEAT EXCHANGER TUBE THAT INCLUDES AN INTERNAL FIN STRUCTURE THAT IS A SPRING FORMED FROM A SPIRAL WIRE WOUND AROUND A MANDREL

(75) Inventor: Risto Castrén, Lahti (FI)

(73) Assignee: Retermia Oy, Heinola (FI)

( * ) Notice: Subject to any disclaimer, the term of this patent is extended or adjusted under 35 U.S.C. 154(b) by 867 days.

(21) Appl. No.: 12/200,605

(22) Filed: Aug. 28, 2008

(65) Prior Publication Data

US 2009/0056131 A1 Mar. 5, 2009

(30) Foreign Application Priority Data

Aug. 31, 2007 (FI) ..... 20075602

(51) Int. Cl.
*B23P 15/26* (2006.01)
*F16L 11/16* (2006.01)

(52) U.S. Cl. ..... 29/890.046; 29/890.04; 29/890.48; 29/890.49; 29/452; 29/227

(58) Field of Classification Search ..... 29/890.04, 29/890.046, 890.048, 890.049, 227, 451, 29/452, 277
See application file for complete search history.

(56) References Cited

U.S. PATENT DOCUMENTS

| | | | | |
|---|---|---|---|---|
| 1,802,161 | A * | 4/1931 | Summers | 29/468 |
| 2,152,437 | A * | 3/1939 | Lear | 228/37 |
| 2,191,025 | A * | 2/1940 | Mitchell | 264/262 |
| 2,300,057 | A * | 10/1942 | Meyer | 285/114 |
| 2,329,286 | A * | 9/1943 | Meyer | 29/227 |
| 2,734,262 | A * | 2/1956 | Briegel | 264/313 |
| 2,797,730 | A * | 7/1957 | Martin | 264/159 |
| 2,913,009 | A * | 11/1959 | Kuthe | 138/38 |
| 2,936,517 | A * | 5/1960 | Brown, Jr. et al. | 29/890.049 |
| 2,941,571 | A * | 6/1960 | Rothermel | 156/144 |
| 2,961,749 | A * | 11/1960 | Brown, Jr. et al. | 29/890.049 |
| 3,265,276 | A * | 8/1966 | Roffelsen | 228/17 |
| 3,730,229 | A * | 5/1973 | D'Onofrio | 138/114 |

(Continued)

FOREIGN PATENT DOCUMENTS

FI 852641 A 1/1987

(Continued)

OTHER PUBLICATIONS

Search Report issued in FI20075602, Jul. 26, 2008.

*Primary Examiner* — David Bryant
*Assistant Examiner* — Jason L Vaughan
(74) *Attorney, Agent, or Firm* — Stiennon & Stiennon

(57) ABSTRACT

A method and equipment for making a needle-fin tube having needle-like external fin parts, and internal fin structure formed by a spiraled spring wire which expands to clamp again the tube in the needle-fin tubes. The wire used to form the internal fin is wound along and around a bar which is moved and rotated along a straight line. The bar is moved inside the needle-fin tube from its one end to the other and the wire is released from the bar to attach to the internal surface of the needle-fin tube under spring force.

13 Claims, 9 Drawing Sheets

U.S. PATENT DOCUMENTS

| | | | | | |
|---|---|---|---|---|---|
| 3,777,343 | A | * | 12/1973 | D'Onofrio | 29/890.036 |
| 3,787,956 | A | * | 1/1974 | Miller | 29/451 |
| 3,826,304 | A | * | 7/1974 | Withers et al. | 165/179 |
| 4,124,971 | A | * | 11/1978 | Taylor et al. | 57/9 |
| 4,270,690 | A | * | 6/1981 | Mabery et al. | 228/173.5 |
| 4,589,447 | A | * | 5/1986 | Kane et al. | 138/98 |
| 5,167,275 | A | * | 12/1992 | Stokes et al. | 165/109.1 |
| 5,390,494 | A | * | 2/1995 | Clegg | 60/299 |

FOREIGN PATENT DOCUMENTS

| | | | |
|---|---|---|---|
| GB | 1488443 | A | 10/1977 |
| JP | 54068550 | A | 6/1979 |
| JP | 61105100 | A | 5/1986 |
| JP | 61172616 | A | 8/1986 |
| JP | 63254397 | A | 10/1988 |
| JP | 2007064514 | A | 3/2007 |

* cited by examiner

METHOD AND APPARATUS FOR FORMING A FINNED HEAT EXCHANGER TUBE THAT INCLUDES AN INTERNAL FIN STRUCTURE THAT IS A SPRING FORMED FROM A SPIRAL WIRE WOUND AROUND A MANDREL

CROSS REFERENCES TO RELATED APPLICATIONS

This application claims priority on Finnish App. No. 20075602, filed Aug. 31, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns equipment and a method for making a needle-fin tube, and a needle-fin tube.

It is characteristic of indirect heat transfer and cooling systems that the operating temperature of the liquid circulating in the liquid circulation network will drop below zero Celsius degrees. A mixture of water and some agent preventing the water from freezing is hereby often used as the heat carrier liquid. Mono-ethylene glycol and mono-propylene glycol are the anti-freeze agents most frequently used. With an increasing content of anti-freeze agent and a lowering temperature, the flow in the smooth tube will easily be laminar, whereby the heat transfer coefficient between the liquid and the tube surface is low and the thermal resistance is hereby high. As a result of this the value of the heat delivery surface's coefficient of thermal transmittance remains small, which can be compensated for by increasing the heat delivery surface area or, on the other hand, steps can be taken to improve the value of the heat transfer coefficient of the liquid side.

As a solution to improve the heat transfer coefficient of the liquid side a turbulator wire is used, which is installed inside the tube (a passive method for boosting the heat transfer), owing to which the flow is made turbulent even at low flow velocity values, and the heat transfer is thus made more efficient.

SUMMARY OF THE INVENTION

The present application presents a method and equipment with which a needle-fin tube can be finned industrially and quickly on the inside with a separate wire. Said turbulence wire is brought in contact with the internal surface of the needle-fin tube, whereby it is released to said surface and it attaches to this by its own tension and spring force. No kinds of attaching means, glues or other means are required.

In the early stage of feeding, a transfer unit brings the tubes to a so-called turbulator machine, that is, a wiring machine. A wire-feeding unit for its part moves the wire to a lower position and brings the wire along when descending. A separate cylinder of a support lever or support rod moves the support lever to a so-called internal station to support the needle tube. A feeding bar ("rassi") then moves forward, so that the wire will move to the bottom of a V-shaped opening in the end of the feeding bar. The bar is then being rotated in a clockwise direction, whereby the wire will attach to the groove in the end of the opening in the bar.

A low feeding speed is used to begin with, to do a few turns of wire at a closer pitch, whereby a support surface is formed at the end of the feeding bar. In this manner the end of the feeding bar is prevented from scratching the tube's internal surface and its guiding is supported, should there be variations in the straightness in the needle tube.

The feeding speed is then increased to be suitable for the desired pitch of the turbulator wire or fin wire, whereby the feeding bar will enter the needle tube. At the same time, the speed of rotation of the feeding bar is kept at its desired value.

The fin wire traveling from a reel travels through a wire brake, which is located in the wire-feeding unit and which can be used to keep the wire under a suitable tension. The tube transfer unit is intended to hold the tube, whereby the tube is prevented from rotating during the wiring.

The present application uses a separate feeding bar (a so-called "rassi") moved by a cylinder device actuator and comprising an end notch for attaching a wire to the end of the feeding bar. Said notch is preferably a so-called V notch. The actuator brings the wire into said notch, whereupon the bar is first rotated with a small pitch and at a low speed of rotation, and the rotation speed and pitch are then increased according to the requirement of each finned tube. As the wire is thus attached to the rotated bar or feeding bar, the rotation is continued in a clockwise direction and the finned tube is supported at the same time to prevent it from rotating. While rotating the feeding bar, the actuator is used to move the feeding bar in a linear manner inside the finned tube. When the feeding bar has been fed out of the end of the finned tube, a photo cell will detect the arrival of the feeding bar at the end station. The feeding out of the bar then stops and the bar is rotated in place for a few revolutions, for example, five revolutions, whereby the wire will come off the groove in the end of the bar. According to the invention, as the feeding bar reaches the final end of the needle tube in the manner described above, a photo cell identifies the feeding bar, whereby after a programmed distance the feeding and rotation will stop. A separate cutter will hereby cut the wire and the wire feeding unit will rise up bringing the wire along. The bar can then be removed from inside the needle-fin tube and the tube which has been thus finned inside can be delivered to further treatment.

As the wire is removed from the feeding bar, the feeding bar is rotated in place in a counter-clockwise direction for a few revolutions, whereby the wire will come off the end of the feeding bar. Under continued rotation the feeding bar is pulled out from inside the tube. When the feeding bar has been pulled entirely out from inside the tube, the cylinder will push the support lever back into the outer position to once again support the wire feeding stage. At this stage, the tube transfer unit moves the tubes to further treatment. The wire has a certain pitch and the wire has a circular cross-section and it is preferably made of metal.

The invention will be described in the following by referring to the figures in the appended drawings and to the advantageous embodiments shown in the figures, but there is no intention to restrict the invention to these embodiments only.

DESCRIPTION OF THE PREFERRED EMBODIMENTS

Figure 1A:
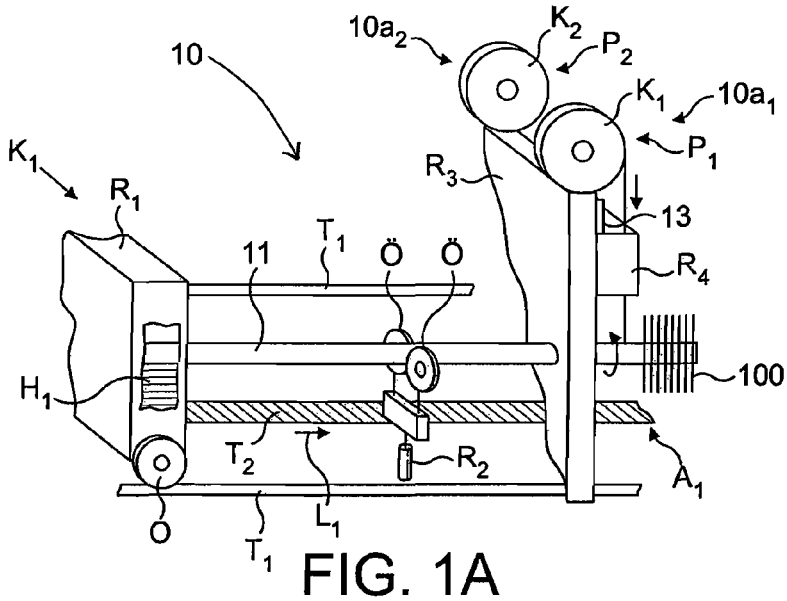
FIG. 1A illustrates the equipment according to the invention for making a fin brought inside a tube for a heat transfer agent in a spiral internal needle-fin tube and for attaching it to the inside surface of the tube. The presentation in FIG. 1A is illustrating.
Figure 1B:
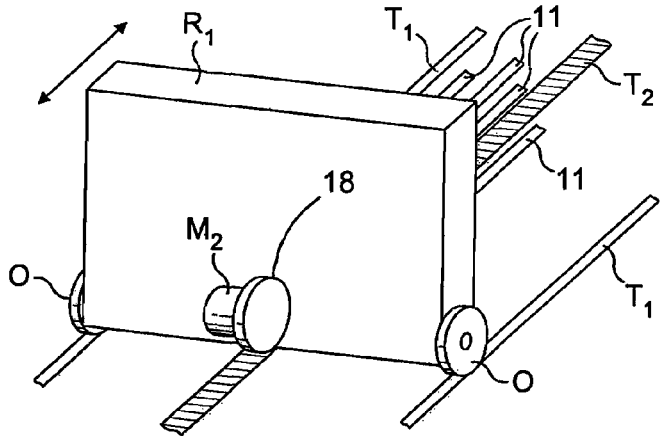
FIG. 1B illustrates a body $R_1$, which is moved on guide bars with the aid of a motor and which body comprises rotating equipment for a bar or feeding bar.
Figure 1C:
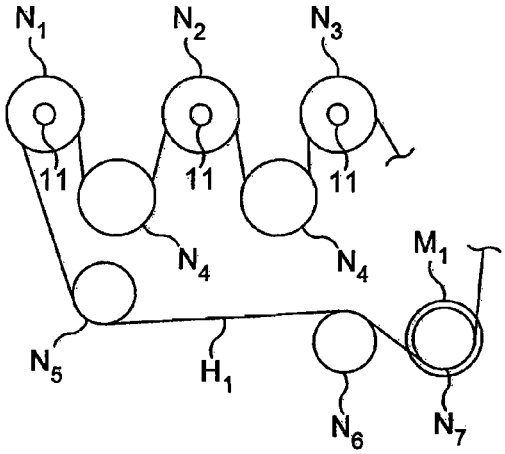
FIG. 1C illustrates rotation with the aid of the same toothed belt or other such of bars located beside one another.
Figure 2A:
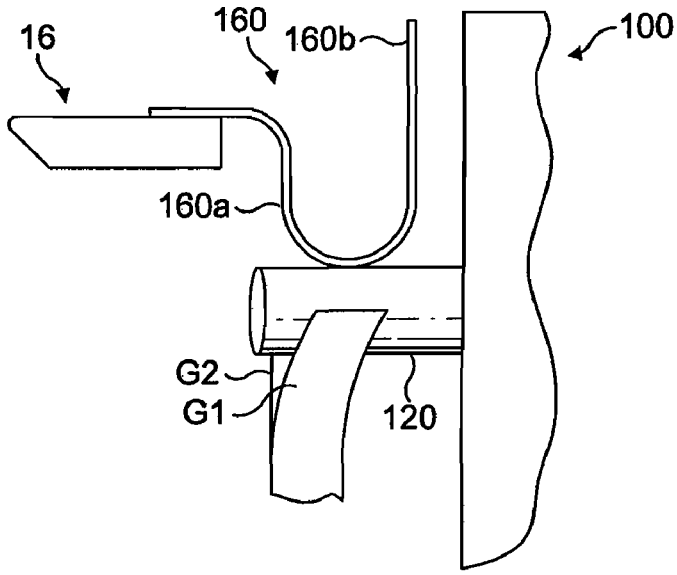
FIG. 2A shows a flexible supporting part located in the support rod, with the aid of which supporting part the tube to be finned can be kept in place as the spiral fin-making is taking place on the bar.
Figure 3C:
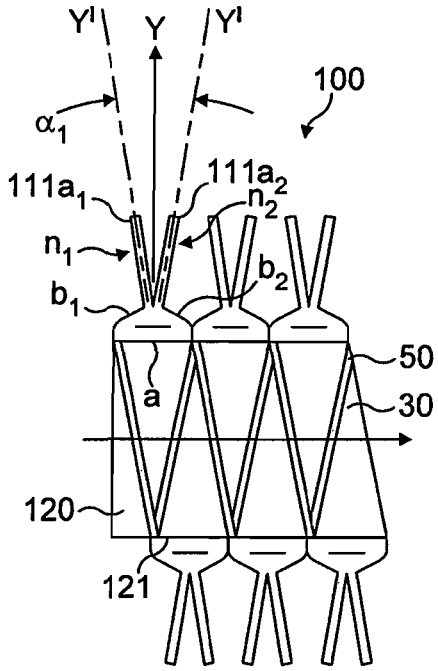
FIG. 3C is a cross-sectional view along line IV-IV of FIG. 3B.
Figure 4A:
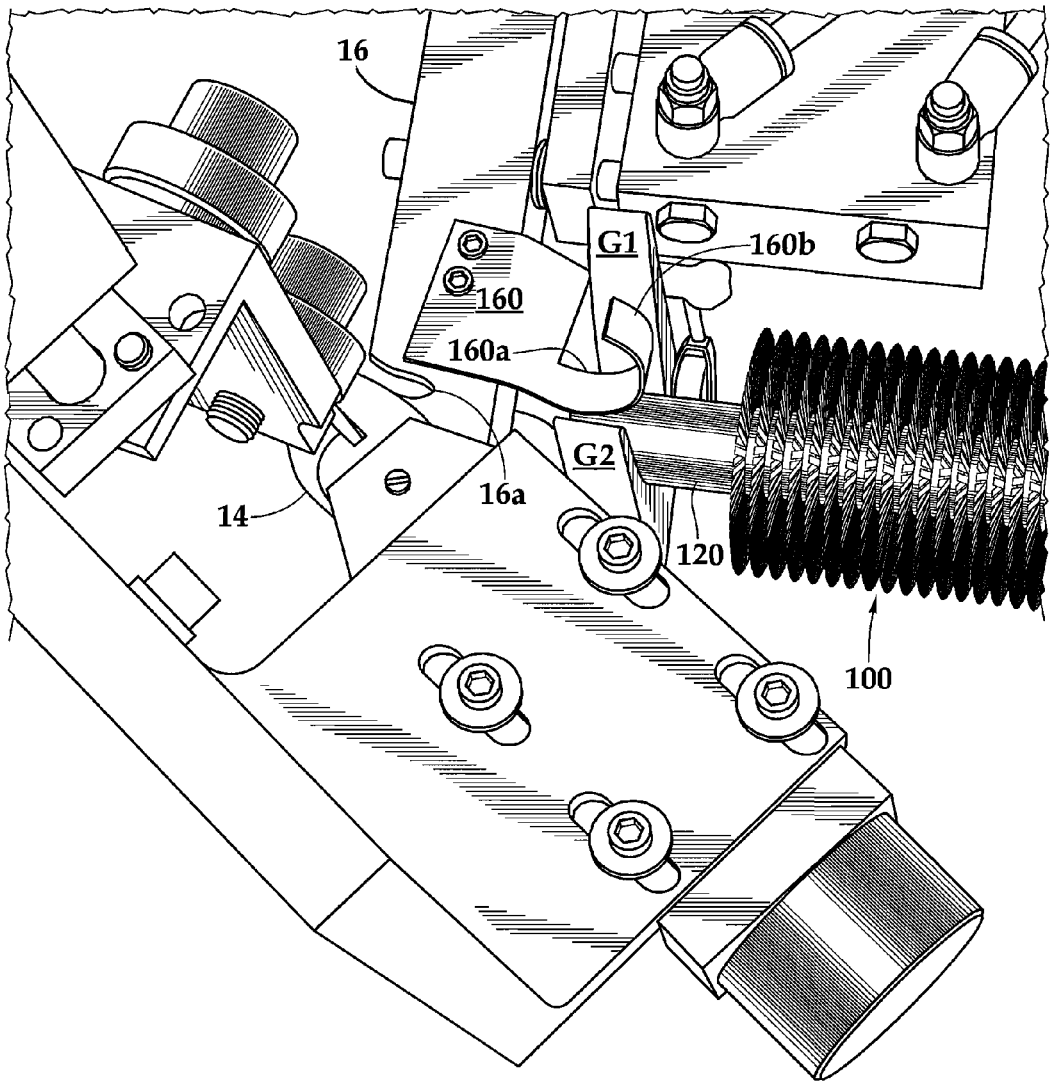
FIG. 4A shows a counter part, which is located at an early stage of the fin making and which is used to support the transfer of the wire into a notch in one end of the bar at the early stage of fin making.
Figure 4B:
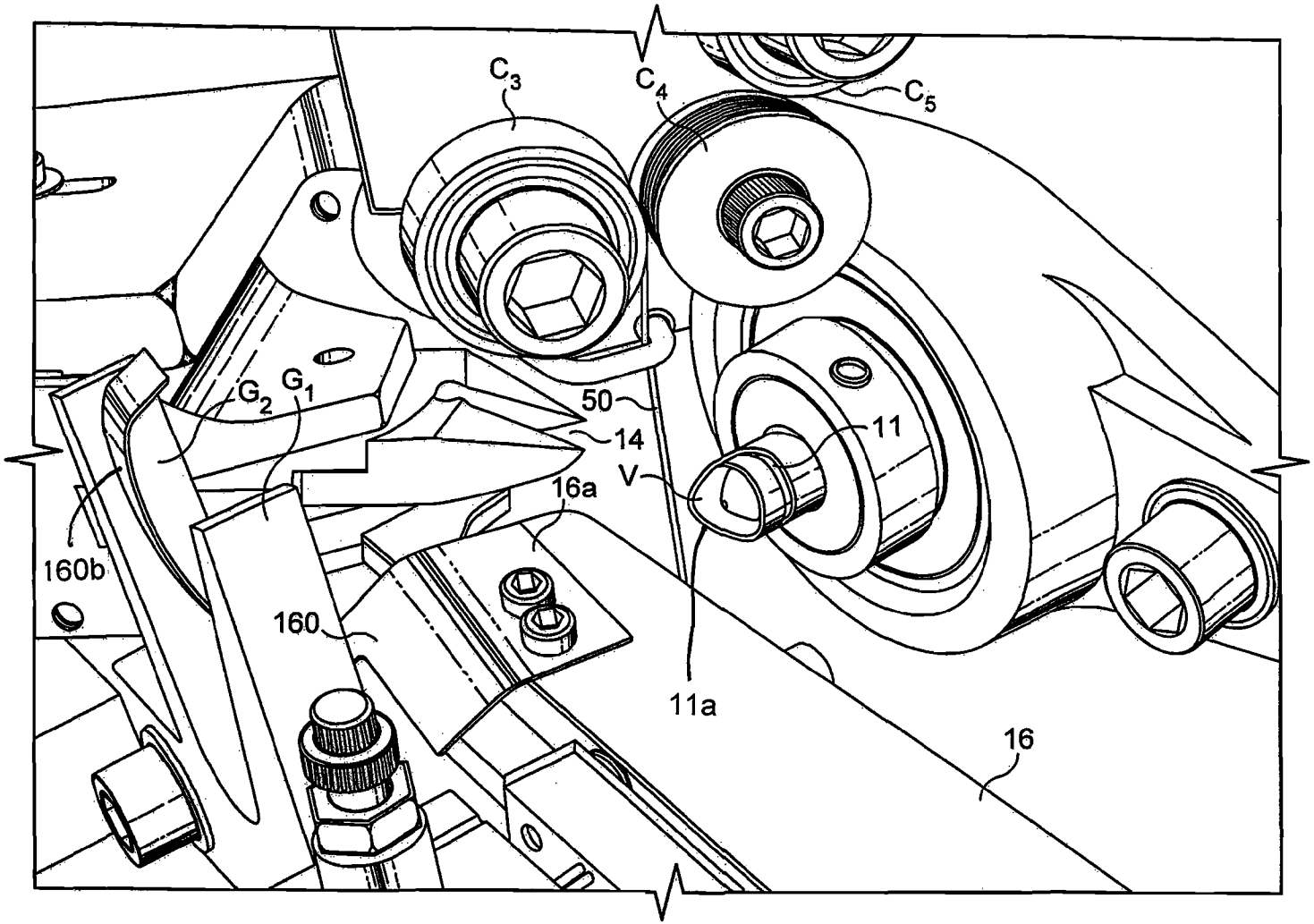
FIG. 4B shows the stage of FIG. 4A from a different direction in order to show the structures.
Figure 4C:
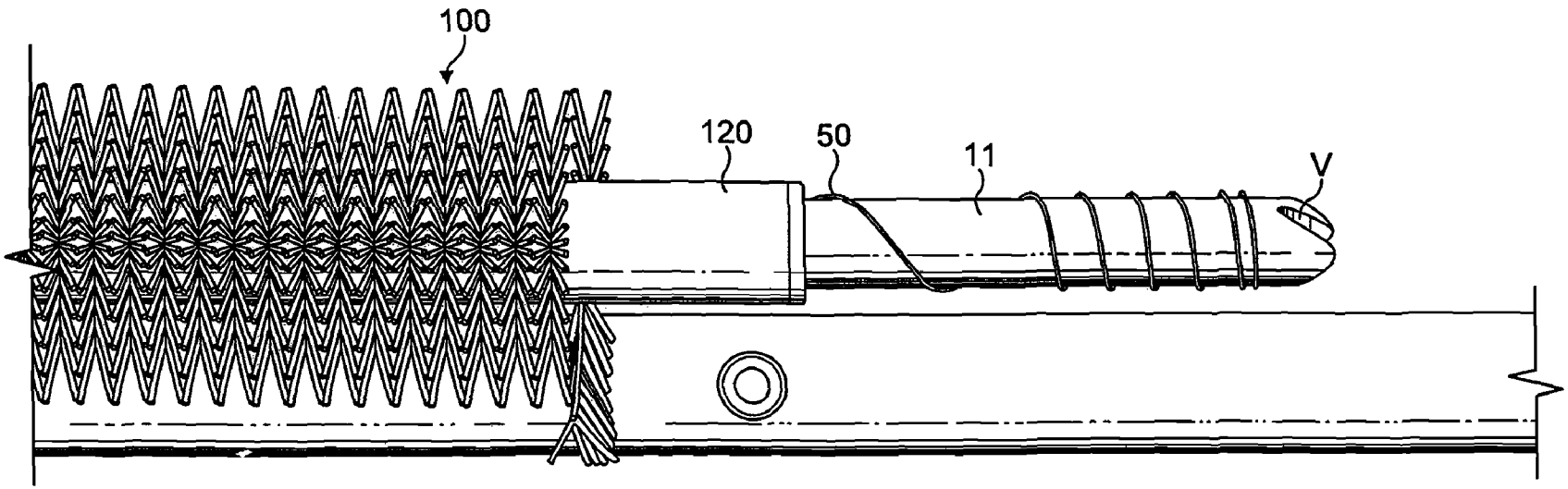
FIG. 4C shows the arrival of the wire from the end of the feeding bar before the wire is released to the internal walls of the heat carrier tube under the wire's spring force.

FIG. 1A is an illustrating view of equipment 10 used in the making of a so-called turbulence tube according to the invention. A body $R_1$ comprises a motor $M_2$, shown in FIG. 1B, whose driving wheel 18 is connected to a toothed bar $T_2$, whereby the body $R_1$ is moved on guide bars $T_1$ as shown in FIG. 1B. As shown in FIG. 1C, body $R_1$ has rotating equipment $M_1$, $H_1$, $N_1$, $N_2$ . . . for rotating the bar 11 in each fin-making station 10$a_1$, 10$a_2$ . . . and it rotates the bar. In this manner the bar 11 is moved forward and it is being rotated. In accordance with the invention, the equipment 10 in a needle-fin tube 100 in tube 120 mechanically and automatically makes internal fins 30, which are formed of a wire 50 and which circulate spirally inside the tube stretch 120, shown in FIG. 2A, of needle-fin tube 100 from one end to the other of the tube 120 for a heat carrier, and which is attached to its inside surface under its own spring force without any separate attaching means. According to the invention, the needle-fin tube structure 100 comprises a heat carrier tube 120, on the surface of which a fin strip 121, shown in FIG. 3C is wound, which fin strip 121 comprises two needle-fin rows $N_1$, $N_2$, wherein opposite needle-like fins 111$a_1$, 111$a_2$ . . . are at an acute angle $\alpha_1$ in relation to one another. In addition, the needle fins 111$a_1$, 111$a_2$ . . . are rectangular structures comprising a surface deviating the flow. At their planar surfaces they are mutually at different angles, which is achieved by drawing the needle-fin strip into contact with a surface of the heat carrier tube 120. In accordance with the invention, after the winding the spirally and mechanically wound wire 50, shown in FIG. 4C, is released from the feeding bar 11, whereupon the wire 50 is wound and taken inside the tube 120. The wire 50 preferably has a round cross-sectional shape and is preferably a metal wire. According to the invention, fins having the desired pitch are formed with the aid of a machine according to the invention by regulating the feeding speed and/or the speed of rotation of the bar 11.

FIG. 1B illustrates the body $R_1$ from the direction of arrow $K_1$ of FIG. 1A.

FIG. 1C is an illustrating view of driving wheels $N_1$, $N_2$ . . . , which are used on belt $H_1$ and which rotate the bar of each fin-making station. Thus, one and the same motor $M_1$ can be used to rotate all bars 11 at the same time.

Figure 1D:
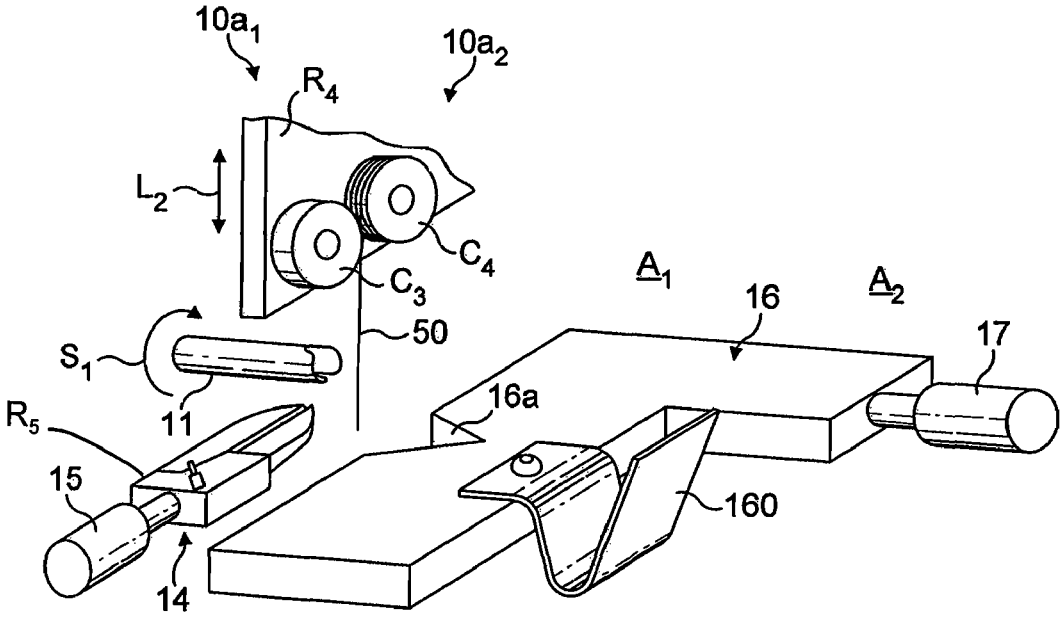
FIG. 1D illustrates guiding of a wire to the end of a bar.

FIG. 1D shows a station A1, where the bar 11 is fed forward and it connects with a wire 50, whereby the wire 50 can be wound spirally around the bar 11 and the bar 11 can be moved forward by feeding it inside a heat carrier tube 120 of a needle-fin tube 100 brought into station A2.

As shown in an illustrating manner in the figures, for forming an internal, spirally extending fin 30 the equipment 10 comprises adjacent machine units 10$a_1$, 10$a_2$ . . . in fin-making stations $P_1$, $P_2$ . . . , which are similar to one another. Thus, the same equipment 10 can be used for making fins in several tubes 120 at the same time. According to the invention, the fin-making takes place with the aid of a bar 11 or feeding bar (a so-called "rassi"), which is rotated and moved in a linear manner inside a tube 120 of a needle-fin tube 100. The bar 11 at its one end comprises a notch V, into which the fin wire 50 is guided. When the wire 50 has been moved into notch V at one end 11*a* of the bar or feeding bar 11, shown in FIG. 4B, the feeding bar 11 is rotated, whereby the wire 50 will be wound on to the surface of feeding bar 11.

When the wire 50 is moved into notch V of the feeding bar 11, the wire 50 is supported with the aid of a support rod 16, and the support rod 16 has portion forming a notch 16*a*, to the bottom of which the wire 50 will arrive at the initial stage of feeding.

As shown in the FIG. 1D, the bar or feeding bar 11 or fin-making bar is rotated in the direction of arrow $S_1$ in a clockwise direction at the early stage of feeding with the aid of motor $M_1$ as the motor $M_1$ is driving a toothed belt $H_1$, which is placed through guiding and driving wheels $N_1$, $N_2$ . . . , such as by way of the driving wheel $N_1$ located at the end of the feeding bar 11. With the aid of the same belt $H_1$ and motor $M_1$ it is thus possible to rotate several feeding bars 11 in adjacent stations $P_1$, $P_2$, $P_3$ . . . and machine units 10$a_1$, 10$a_2$, 10$a_3$ . . . The feeding bar's 11 driving equipment $M_1$, $H_1$, $N_1$, $N_2$ . . . Nn is located at the end body $R_1$. The end body $R_1$ is moved carried by guide bars $T_1$ and it is supported by wheels O on the guiding bars $T_1$. Guiding bar $T_1$ is preferably a round bar and there can be, for example, two of these in the equipment. According to the invention, the body $R_1$ comprises an electrically operating motor $M_2$, which is adapted to connect with a toothed bar $T_2$ at its driving wheel 18 and thus to move the body $R_1$ and the bars, that is, the feeding bars 11 connected to it as the feeding is taking place.

In accordance with the invention, the bars 11 can be supported by supporting rollers or wheels Ö in auxiliary bodies $R_2$ as shown in FIG. 1A. The height position of support rollers Ö can be adjusted by a cylinder device. At a distance from the point where the feeding starts, there is a fixed body $R_3$, in which reels $K_1$, $K_2$ . . . for the fin wire 50 are located. The wire 50 for use in the fin-making is fed from the reels $K_1$, $K_2$ . . . in the adjacent stations $P_1$, $P_2$ . . . into each machine unit 10$a_1$, $10a_2$ . . . . The support body $R_3$ comprises an auxiliary body $R_4$, shown in FIG. 1D which can be moved vertically as shown by arrows $L_2$ in relation to body $R_3$ and which comprises guiding wheels $C_1$, $C_2$, $C_3$ and $C_4$ and a wire brake $C_5$ for the wire 50, shown in FIG. 2B. The wire 50 is thus taken through the nip between the guiding wheels $C_1$ and $C_2$ and further to the wire brake $C_5$ and from this further into the nip between the guiding wheels $C_3$ and $C_4$ and further downwards. The wire 50 is hereby straightened in the nips as it arrives from a reels such as K1 and K2. The wire 50 is fed to be in front of the end 11*a* of feeding bar 11 by moving the auxiliary body $R_4$ in relation to body $R_3$ by the cylinder device 13 shown in FIG. 1A. At the lower station of body $R_3$ there is a body part $R_5$, see also FIG. 2C, which can be moved by an actuator 15 and in which there is a cutter 14, which is moved by the actuator 15, such as a cylinder device, in direction $L_3$, whereby the cutter 14 is brought into connection with the wire 50 and it can be used for performing the cutting motion $S_2$ shown in FIG. 2C by moving the jaw 14*a* of the scissors by the actuator 14*c*, such as a pneumatic cylinder, against the spring force of spring $J_{10}$.

In FIG. 1D the wire 50 feeding stage $R_4$ moves (arrow $L_2$) the wire 50 into the notch V in the end 11*a* of bar 11, the wire 50 is taken to the lower station A1. With the support rod 16 shown in FIG. 1E, 4A, and 4B, and brought to the station A1 with the aid of notch 16*a*, the wire 50 is supported on the bottom of the slot or notch V of bar 11 as feeding of the wire 50 is started.

Figure 1E:
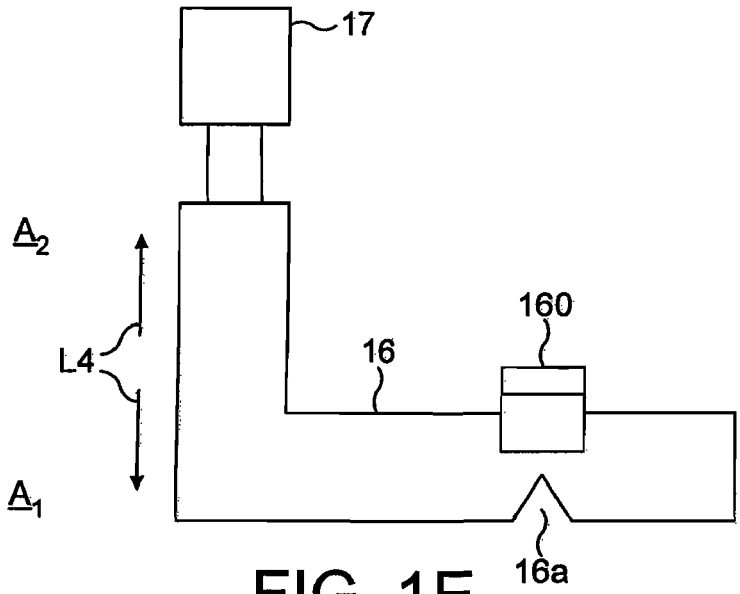
FIG. 1E shows a view from above of a support rod used for guiding the wire.

Said position A1 is also the forward position of the support rod 16, and when the wire 50 has been fed into notch V in the end 11*a* of feeding bar 11, rotation (arrow $S_1$) and moving in a linear direction of the bar 11 are started as shown by arrow $L_1$ in FIG. 1A, forward into the tube part 120 of the needle-fin tube 100. The support rod 16 can then be moved to a forward position A2, whereby a curved supporting part 160 in the support lever 16 is brought against the surface of the needle-fin tube's 100 tube part 120 and it is supported thereon by its spring force. Thus, at the station A2 the support part 160 is used to support the needle-fin tube 100 during the feeding event. The support rod 16 can be moved as shown in FIG. 1E by an actuator 17, such as a cylinder device, from station A1 to station A2 and vice versa. At the station A2 the support part 160 is used to support the end of tube 120 as the tube 120 is located at its end in the guides $G_1$, $G_2$ shown in FIG. 2A and 4A.

Figure 2B:
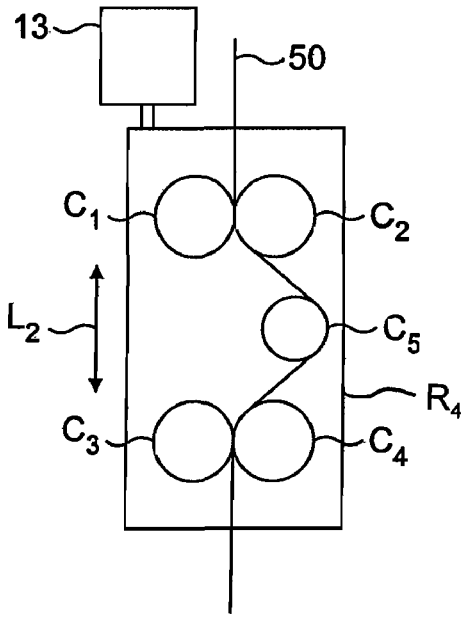
FIG. 2B is a view in principle of a wire brake.
Figure 2C:
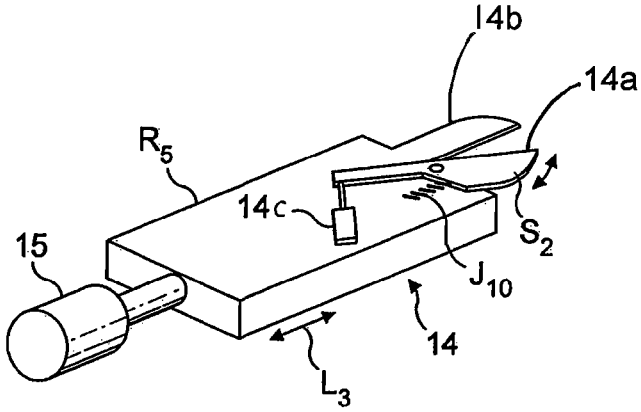
FIG. 2C is a view in principle of a wire-cutting device.
Figure 2D:
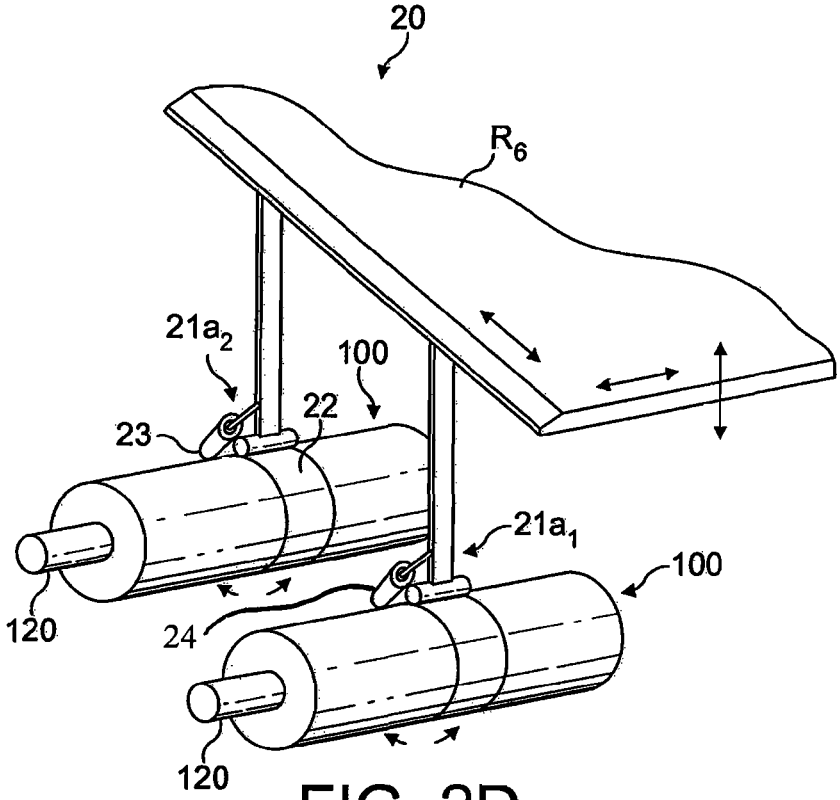
FIG. 2D shows a device for moving finned tubes, which is also used for holding the finned tube during the formation of the spiral internal fin for the heat carrier.

As illustrated in FIG. 2D, the equipment 10 further comprises moving equipment 20 for the needle-fin tubes 100, which equipment in body $R_6$ comprises gripping parts $21a_1$, $21a_2$ . . . and in these jaw parts 23, 24, which are operated by a cylinder device and which are used for gripping the needle-fin tube 100 in order to move it to the station $P_1$, $P_2$ . . . where the internal fins 30 are made. At the same time it is a purpose of the device's 20 gripping parts $21a_1$, $21a_2$ . . . to hold on to the needle-fin tubes 100 during the internal fin-making as the spiral and helical internal fin 30 shown in FIGS. 3B and 3C, is being formed.

FIG. 2A shows a separate view of the support rod's support part 160. The support part 160 comprises a downward-extending curved stretch 160*a*, the outer surface of which will be located against the outer surface of the needle-fin tube's 100 tube part 120. The support part 160 also comprises an upward-extending stretch 160*b*. The curved part 160 works with its spring force and it is kept under force against the top surface of tube 120, whereby the end of tube 120 is supported.

FIG. 2B illustrates a wire-feeding station in body $R_4$, which is moved by an actuator 13 in relation to body $R_3$. The wire 50 travels through support rollers $C_1$, $C_2$, $C_3$, $C_4$ and a brake wheel $C_5$, and the purpose of support rollers $C_1$, $C_2$, $C_3$, $C_4$ is to straighten the wire 50 as it is being released from reel K, where it is located as a coil.

FIG. 2C illustrates the action of cutter 14. One scissors part 14*a* is moved by an actuator 14*c* against the spring force of spring $J_{10}$ whereas the other scissors-half 14*b* is in a fixed position. The cutter 14 is in the body $R_5$ and it is moved by actuator 15 into cutting station A1 and out of it.

FIG. 2D illustrates a transfer device 20 for the needle-fin tubes 100. The transfer device 20 comprises a body $R_6$, which is moved by actuators downwards and upwards (not shown) and in lateral directions. The transfer device 20 comprises gripping parts $21a_1$, $21a_2$ . . . and in these actuators, with which the jaws 22, 23 of the gripping parts $21a_1$, $21a_2$ . . . are opened and the fin tubes 100 are gripped and several needle-fin tubes 100 are moved at the same time into the fin-making stations $P_1$, $P_2$ . . . to end up in between guiding slots $G_1$, $G_2$ located therein as shown in FIGS. 2A, 4A, and 4B.

Figure 3A:
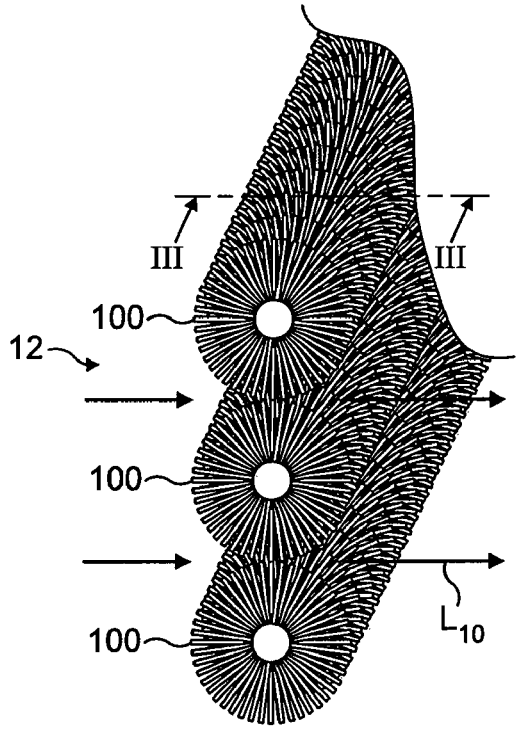
FIG. 3A shows a wall structure formed of a needle-fin tube.
Figure 3B:
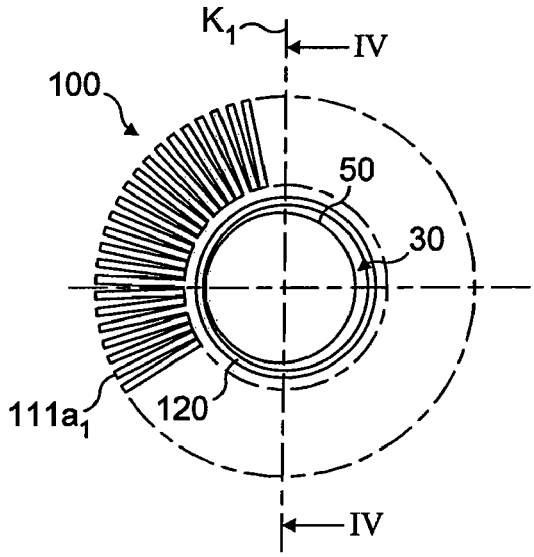
FIG. 3B is a cross-sectional view along line III-III of FIG. 3A.
Figure 3D:
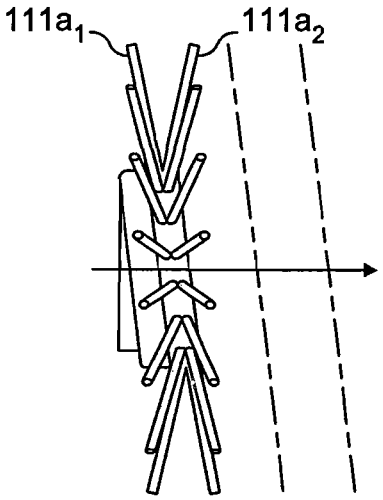
FIG. 3D shows the fin tube structure of FIG. 3C in the direction of arrow $K_1$ in FIG. 3C.

FIG. 3A shows a needle-fin tube 100 according to the invention. FIG. 3B is a cross-sectional view along line III-III of FIG. 3A, and FIG. 3C shows a fin strip as a cross-sectional view along line IV-IV of FIG. 3B. FIG. 3D shows the structure in the direction of arrow K, of FIG. 3B. As shown in FIGS. 3A, 3B, 3C and 3D, the needle-fin tube solution 100 comprises a central tube 120, to which the fin strip 121 is joined by winding and gluing it around the tube 120.

Figure 3E:
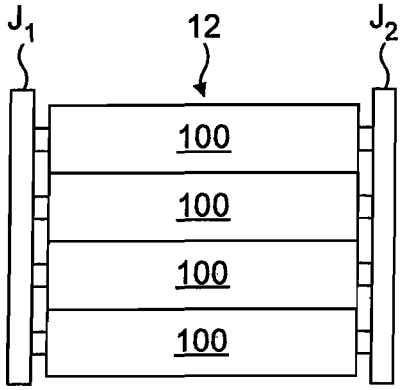
FIG. 3E shows a wall structure formed of fin tubes in between manifolds $J_1$ and $J_2$.

As shown in FIGS. 3A-3D, the needle-fin strip 121 has two adjacent needle rows n1 and n2, wherein the opposite needle fins $111a_1$, $111a_2$ are at an acute angle a1 in relation to one another. Said angle $\alpha_1$ is an acute angle, whereby impurity particles will remain attached in different height positions in between adjacent fins $111a_1$, $111a_2$. The needle-fin tube 100 works both as a filter and as a heat exchanger. Heat can be transferred through it from the heat carrier made to flow inside tube 120 through the needle fins $111a_1$, $111a_2$ . . . into the air or heat can be transferred in the opposite direction from the air from flow $L_{10}$ through the needle fins $111a_1$, $111a_2$ . . . into the tube's 32 central heat carrier made to flow therein, whereby the airflow $L_{10}$ is being cooled. Both purposes of use are possible. The fin strip 121 comprises a base part and folded covering parts $b_1$ and $b_2$, to which the needle fins $111a_1$, $111a_2$ . . . are joined. Thus, the needle-fin tubes 100 can be used in the manner shown in FIG. 3E. The needle-fin tubes 100 are formed as a filter wall 12, whereby a heat carrier is conducted from manifold $J_1$ into the needle-fin tube 120 of each wall 12 and the heat carrier is removed from the manifold $J_2$. The wall 12 forms a pre-filter, a so-called rough filter, and a heat exchanger, whereupon the equipment comprises a fine filter, which can be used for removing impurity particles of a smaller particle size from the air after the pre-filtration.

FIG. 3C shows fins 30 and a fin wire 50 according to the invention inside a tube 120. The fins 30 have been made by using the equipment and method described in the foregoing.

FIG. 4A shows the initial station A1 of fin-making, in which feeding of the wire 50 forming the fin 30 is started into the heat carrier tube 120 of the needle-fin tube 100. The wire 50 is guided from the nip between wheels $C_3$ and $C_4$, shown in FIG. 4B.

FIG. 4A shows in particular a support rod 16 and a slot, such as a V notch 16*a* therein, with the aid of which the wire 50 is supported as it is taken into the notch V in the end 11*a* of bar 11, shown in FIG. 4B.

FIG. 4B shows a station such as A1 corresponding to FIG. 4A from a different direction. The needle-fin tube 100 is not yet in the station.

FIG. 4C shows the final stage of fin-making, wherein the bar 11 leaves the end of tube 120 and the wire 50 has not yet been released from the slot V. The release will take place by changing the direction of rotation of bar 11.

For controlling the equipment according to the invention several sensor devices are used to determine the motion positions and to synchronize the inter-related operations of the actuators. For example, the speed of rotation of the bar's 11 rotating device can be controlled by step-less control and/or the feeding speed of the bar's 11 linear motion can also be controlled in a linear manner, and said speeds can be measured with the aid of sensors in order to achieve the correct control. An optimum transfer of heat from the heat carrier to the fins of the needle-fin tube or in the opposite direction is achieved in this manner, and the heat transfer is dependent on the operating conditions at each time and also, for example, on the pressure and temperatures of the liquid.

I claim:

1. A method of making a needle-fin tube having an internal fin structure comprising the steps of:

providing a needle-fin tube having needle-like fin parts wrapped around a tube for a heat carrier liquid, placing within the tube an internal fin structure in the form of a spiral wire which is elastically biased against an inner wall defined by the tube;

wherein a wire is brought to releasably attach to a cylindrical bar, which bar is rotated to wind the wire about the bar and linearly transferred while rotating to form thereon the spiral wire as a spring wound along the bar and attached to the bar;

wherein the spiral wire wound along the bar and attached to the bar is moved inside the tube so that the spiral wire wound along the bar extends from a first end to a second opposite end of the tube; and wherein the spiral wire wound along the bar is released from the bar to attach to the inside surface of the tube under a self-generated spring force.

2. The method of claim 1 wherein the wire is provided from a wire reel to a notch at one end of the cylindrical bar, and wherein the cylindrical bar is rotated, whereby the wire is attached to said one end of the bar, and the bar is moved in a linear manner inside the tube and the cylindrical bar is rotated at the same time.

3. The method of claim 2 wherein the wire is provided from the wire reel by way of wheels, which maintain a selected tension in the wire, and the wire is taken into the notch in one end of the bar and it is moved to the bottom of the notch with the aid of a support rod.

4. The method of claim 3 wherein the support rod is moved to a position where it holds the needle-fin tube with a counter part having an elastic curved downward-extending counter stretch and an upward-extending counter stretch, the counter part being mounted to the support bar and holding the needle-fin tube in place with a spring force in the curved downward-extending counter stretch.

5. The method of claim 4 wherein the support rod is taken from a first station to a second station, in which the elastic curved downward-extending counter stretch supports the needle-fin tube and in which first station the transfer of the wire into the notch in the end of bar is supported.

6. The method of claim 1 wherein a round wire is formed into the spiral wire which is elastically biased against the inner wall defined by the tube.

7. The method of claim 1 wherein during the formation of the internal fin structure in the form of a spiral wire the needle-fin tube is supported in jaws of a transfer device which hold the needle-fin tube while the internal fin structure is being formed.

8. The method of claim 1 wherein in the method several adjacent needle-fin tubes are formed simultaneously, and a motor and belt drive rotates several cylindrical bars at the same time, and wherein a body to which the motor and belt drive is mounted is moved in a linear manner in order to move a plurality of internal fin structures, each in the form of a spiral wire, at the same time inside the adjacent needle-fin tubes.

9. The method of claim 1 wherein when the wire has been guided inside the tube of the needle-fin tube the wire is cut off by a cutter.

10. The method of claim 1 further comprising monitoring the different stages of forming the internal fin structure with sensor devices.

11. The method of claim 1 wherein the cylindrical bar speed of rotation is adjusted and changed and likewise the speed of the bar linear motion is adjusted and changed to control the pitch of the spiral wire in its spiral and helical travel.

12. A method of making a needle-fin tube having an internal fin structure comprising the steps of:

providing a wire from a wire reel to a notch or slot at one end of a cylindrical bar;

rotating the cylindrical bar so that the wire is releasably attached to said one end of the bar in said notch or slot;

further rotating the bar to wind the wire about the bar and linearly transferring the bar to form on the bar a spiral wire as a spring wound along the bar and attached to the bar;

moving the bar and the spiral wire wound along the bar inside a needle-fin tube for a heat carrier liquid, the tube having an internal surface and having needle-like fin parts wrapped around the tube, so that the spiral wire wound along the bar extends from a first end to a second opposite end of the tube; and attaching the spiral wire which is wound along the bar to the internal surface of the tube by releasing the spiral wire from the bar, and by actuation of a cutter to cut off the wire from the wire reel, so that the spiral wire expands under a self-generated spring force to detach from the rod and to attach the spiral wire to the inside surface of the tube by the spring force, elastically biasing the spiral wire against an inner wall of the tube.

13. The method of claim 12 further comprising the steps of:

bringing the wire into the notch or slot by moving the bar with an actuator;

rotating the bar in a first direction with a small pitch and at a low speed of rotation;

increasing the pitch and speed of rotation in the first direction to attach more wire about the rod, at the same time supporting the finned tube to prevent it from rotating;

while the bar is rotating, using the actuator to move the bar by a linear motion inside the finned tube;

stopping the linear motion when the bar has been fed through the finned tube; and rotating the bar in place in a second direction opposite the first direction so that the wire will come off the notch or slot in the end of the bar.

* * * * *